United States Patent [19]

Ramaiah et al.

[11] Patent Number: 4,866,328

[45] Date of Patent: Sep. 12, 1989

[54] ELECTRIC LAMP WITH REDUCED INTERNAL PHOTOELECTRON PRODUCTION

[75] Inventors: Raghu Ramaiah, Painted Post; Daniel H. Shumway, Watkins Glen, both of N.Y.

[73] Assignee: North American Philips Corp., New York, N.Y.

[21] Appl. No.: 181,791

[22] Filed: Apr. 15, 1988

[51] Int. Cl.[4] ..... H01J 61/44

[52] U.S. Cl. ..... 313/25; 313/626

[58] Field of Search ..... 313/25, 112, 626

[56] References Cited

U.S. PATENT DOCUMENTS

| | | | |
|---|---|---|---|
| 3,484,637 | 12/1969 | van Boort et al. | 313/571 X |
| 3,780,331 | 12/1973 | Knochel et al. | 313/626 |
| 3,988,628 | 10/1976 | Clausen | 313/112 |
| 4,006,378 | 2/1977 | Silverstein et al. | 313/112 |
| 4,171,498 | 10/1979 | Fromm et al. | 313/485 X |
| 4,469,980 | 9/1984 | Johnson | 313/25 |

*Primary Examiner*—Donald J. Yusko
*Assistant Examiner*—Sandra L. O'Shea
*Attorney, Agent, or Firm*—Emmanuel J. Lobato

[57] ABSTRACT

An HID lamp having parts of its internal metal support covered with a layer of material having a photoelectric work function greater than 5.0 electron volts to reduce internal photoelectron production. The material may be granular zirconium oxide having a photoelectric work function of 5.8 eV.

9 Claims, 1 Drawing Sheet

ELECTRIC LAMP WITH REDUCED INTERNAL PHOTOELECTRON PRODUCTION

BACKGROUND OF THE INVENTION

This application relates to electric lamps that have a light source which produces ultraviolet radiation, and to improvements in such lamps for reducing photoelectron production caused by the ultraviolet radiation within the lamp.

The cause of photoelectron production in electric lamps, and the consequent problems are well documented. See, for example, Waymouth, Electric Discharge Lamps (MIT Press, 1971), Section 10.5. As Waymouth describes in detail, some electric lamps, particularly electric discharge lamps containing ionized mercury, emit a strong flux of ultraviolet radiation. These lamps typically are comprised of a discharge vessel in which an arc discharge occurs, mounted within an outer envelope by metal support structure. The ultraviolet radiation from the discharge vessel strikes the metal support causing the emission of photoelectrons.

Photoelectron emission can be very detrimental to certain electric lamps. In metal halide discharge lamps the discharge vessel is typically quartz and contains during lamp operation an ionized plasma of mercury, sodium, a halogen such as iodine, and other metals such as scandium and thallium and various compounds of these elements. Sodium ions have a high rate of diffusion through heated quartz. Photoelectrons which collect on the outer surface of the discharge vessel create a negative potential that attracts the positive sodium ions and accelerates their diffusion through the wall of the discharge vessel. The production of photoelectrons substantially accelerates the depletion of sodium within the discharge vessel and thus shortens the useful life of the lamp.

Different measures have been taken in order to diminish the effect of the photoelectrons. One is to reduce the production of photoelectrons by covering metallic structure within the lamp outer envelope with an appropriate material. In some lamps the light source, such as the discharge vessel of a discharge lamp, is supported by a metallic frame structure having a supporting member, typically a rod, extending along the length of the light source. The support rod is metal and is exposed to ultraviolet radiation and consequently emits a substantial flux of photoelectrons.

U.S. Pat. No. 3,484,637 (van Boort et al) discloses a mercury vapor discharge lamp in which the supporting metal rod of the discharge tube support frame is covered by a ceramic tube comprised of alumina and silica. The ceramic tube shields the metal rod from ultraviolet radiation and reduces the production of photoelectrons.

A similar approach is disclosed in U.S. Pat. No. 3,780,331 (Knochel et al) which discloses a discharge lamp in which a ceramic or fused quartz tube covers a support conductor which supports the lamp discharge tube. This patent also teaches the addition of a photoelectron collector and the use of a stainless steel support conductor with a chrome oxide surface, in substitution for the nickel plated iron support conductor usually used. U.S. Pat. No. 4,171,498 (Fromm et al) likewise teaches the use of a quartz tube surrounding the support conductor for reducing photoelectron emission.

All of the lamps disclosed in the above-mentioned references include a straight support rod. The rod is straight because the ceramic or glass tube covering the rod must be straight. It would be impracticable to fabricate curved ceramic or glass tubes so as to allow the use of curved support rods.

An altogether different approach to reducing photoelectron emission is to eliminate the support rod extending along side the discharge tube. U.S. Pat. No. 3,424,935 (Gungle et al) discloses a metal halide lamp having metallic structure for supporting respective ends of the discharge tube at the opposite ends of the lamp outer envelope. No metal support rod extends along the length of the discharge tube for providing mechanical support, but a fine tungsten wire provides a conductive path between the lamp base and the far end of the discharge tube. The elimination of the metal support rod eliminates the source of a substantial portion of the photoelectrons produced by the ultraviolet radiation emitted from the discharge tube.

Another measure for reducing photoelectron production, applicable to both lamp types just mentioned, is the introduction of a gas, such as nitrogen, into the outer envelope. The nitrogen reduces the number of photoelectrons that reach the discharge tube and thus collect on it and impart a negative potential to the tube outer wall.

Still another technique is to construct the discharge tube support so that its metal elements are as far from the discharge tube as is possible. This appears to be of limited effectiveness; however, without other measures being taken. Waymouth reports that the photoelectric current in a lamp having an evacuated outer envelope and a metallic support rod three inches away from the discharge tube is greater than in a lamp having a nitrogen atmosphere in the outer envelope and the metallic support rod only one-half inch away from the discharge tube.

Ideally, one would construct a lamp using more than one photoelectron reduction technique in the lamp. Typically, metal halide lamps are made with a nitrogen atmosphere in the lamp outer envelope, and with a tubular cover, such as quartz or alumina, over the support rod of the discharge tube support structure. Because such tubular glass or ceramic covers are only practicable if made straight, their use constrains the support rod shape to straight. The only other alternative, then, is to dispense with the support rod altogether and to use structure embodying the concept disclosed in U.S. Pat. No. 3,424,935, mentioned above, or to find a new material for covering the metal structure within the lamp.

It is therefore an object of the invention to use a new material for suppressing photoelectron production in lamps having internal metallic structure.

It is another object of the invention to provide means for preventing photoelectron production from metal components within a lamp irrespective of the shape of the components.

Another object of the invention is to provide a discharge lamp having a metallic discharge tube support structure of arbitrary shape covered by a material effective to suppress the emission of photoelectrons.

SUMMARY OF THE INVENTION

According to the invention an electric lamp is comprised of an outer envelope, and a light source that emits ultraviolet radiation. The light source is mounted within the outer envelope by a metallic frame and is exposed to ultraviolet radiation from the light source. A layer of zirconium oxide covers a substantial portion of the metal mounting frame and shields the substantial portion of the frame from the ultraviolet radiation. The layer of zirconium oxide is effective to reduce photoelectron emission from the frame.

In one embodiment the lamp outer envelope has an outwardly bulged bulbous shape. The metallic frame mounting the light source within the outer envelope comprises a rod extending along the length of the lamp envelope away from the light source and adjacent the outer envelope to maximize the distance between the metallic frame and the light source. The layer of zirconium oxide covers substantially the entire rod.

DETAILED DESCRIPTION OF THE INVENTION

Figure 2:
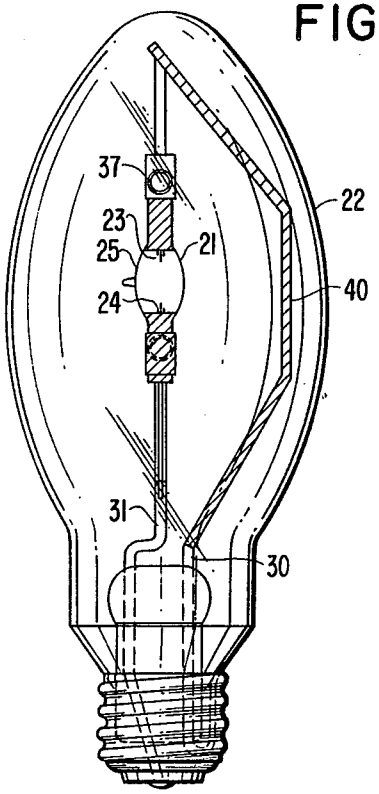
FIG. 2 is an elevation of a discharge lamp according to the invention.

In order to facilitate appreciation of the novel aspects of the lamp according to the invention, the prior art metal halide discharge lamp shown in FIG. 1 will be described first.

The prior art lamp is comprised of a light source 1 housed within an outer envelope 2. The light source 1 is a discharge device having discharge electrodes 3,4 sealed within a quartz discharge vessel 5 and which contains a discharge sustaining filling. The filling comprises sodium, mercury and metal halides such as thallium iodide. In the usual case the discharge device 1 will also contain a rare gas to facilitate starting. Portions of the discharge vessel 5 adjacent the respective electrodes 3,4 are coated with a zirconium oxide layer 6, 7 which suppresses thermal radiation from the coated portions to avoid cooling of the discharge vessel ends. This prevents the discharge vessel from cooling the plasma within it during lamp operation to a lower than optimum temperature.

Conductive lead throughs 8 and 9 are connected to respective discharge electrodes 3, 4, and extend through the discharge vessel 5 for external connection. The conductive support rods 10, 11 define a conductive path for applying a voltage to the discharge electrodes, and also provide mechanical support for suspending the discharge device 1 within the outer envelope 2.

The conductive support rods 10, 11 extend from the stem press 12 into the interior of the lamp. Opposite ends of the conductive support rods are connected to the lamp base 13 within it in a manner so that a voltage applied to the lamp base appears across the conductive support rods.

The lead through 8 is electrically connected to the conductive support rod 10 by a conductive cross support 14. The cross support 14 is welded to the lead through 8 and to the support rod 10 so as to mechanically support the discharge device 1 and provide a conductive path between the support rod 10 and the lead through 8. The other lead through 9 is welded to the shorter conductive support rod 11 to electrically and mechanically connect them. Thus, when a voltage is applied to the lamp base 13 that voltage will be applied to the lead through conductors 8, 9 for establishing a potential difference across the discharge electrodes 3,4.

The support rod 10 has a loop 15 formed at its end adjacent the lamp envelope end. The loop 15 engages an inward protrusion 16 in the end of the lamp envelope to anchor the end of the support rod 10 remote from the stem press 12. A getter support 17 is carried by the cross support 14.

During lamp operation an electrical discharge is developed between the pair of discharge electrodes 3, 4. The discharge develops highly intense visible light which is transmitted from the discharge device 1 and through the lamp outer envelope 2 for the purpose of illumination. Additionally, a strong flux in the ultraviolet region is emitted from the mercury vapor ionization within the discharge device 1. Ultraviolet photons which strike metal support rods 10, 11 cause the emission of photoelectrons from the metal. The free photoelectrons can accumulate on the outer surface of the quartz discharge tube 5 and impart a negative charge to it. The negative charge will accelerate the diffusion of sodium ions through the wall of the discharge tube 5 resulting in the progressive depletion of the sodium concentration within it. This phenomena is referred to as sodium clean-up and is deleterious to lamp quality. As the sodium concentration within the discharge envelope decreases the lamp voltage increases.

In order to reduce the production of photoelectrons caused by the UV photons from the mercury vapor discharge, the lamp support structure is designed to reduce the amount of metal within the outer envelope of the lamp. Good design practice may help here, but any practical discharge vessel support will necessarily include several metal parts of substantial mass and dimensions that are large relative to the overall lamp dimensions.

Another measure taken is to house the major part of the support rod 10 within a quartz sleeve 18. The support rod 10 extends along the length of the discharge tube 5 and consequently will be exposed to UV radiation along its entire length. The quartz sleeve 18 is opaque to ultraviolet radiation and has a high photoelectric work function. Consequently, it shields a substantial portion of the metal rod 10 and does not contribute to the production of photoelectrons. Thus, there will be fewer photoelectrons available to contribute to sodium cleanup than if the quartz sleeve 18 were not present.

Figure 1:
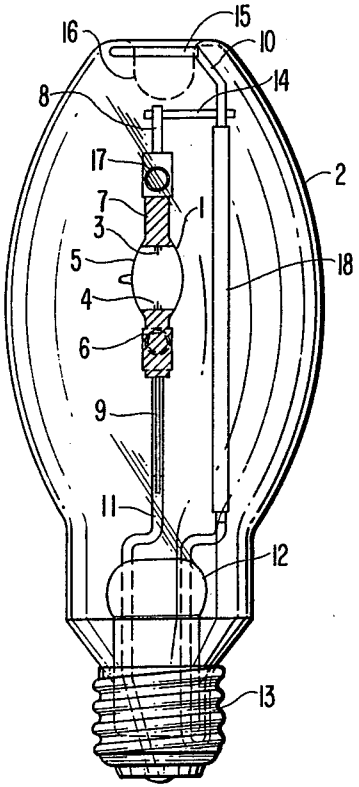
FIG. 1 PRIOR ART
FIG. 1 is an elevation of a discharge lamp having a conventional sleeve for covering internal frame structure to reduce photoelectron production.

FIG. 2 illustrates a metal halide lamp according to the invention in which elements of the lamp corresponding to those shown in FIG. 1 are labelled with reference numerals 20 higher than the reference numerals used in FIG. 1. Thus, the lamp according to the invention has an inner light source 21 housed within an outer envelope 22. The light source 21 is a discharge device having discharge electrodes 23 and 24 disposed in a discharge tube 25. The discharge device 21 is supported by metallic support rods 30, 31 each of which is connected to a respective electrode conductive feed-through at opposite ends of the discharge device 21.

In order to reduce the production of photoelectrons the metallic support and conductor rod 30 is coated with a layer 40 of zirconium oxide ($ZrO_2$). The zirconium oxide is disposed in a layer 40 which covers a substantial portion of the support rod 30 and is effective to shield the substantial portion of the support rod 30 from ultraviolet radiation. The zirconium oxide is granular and is applied mixed with an organic binder for adhering the zirconium oxide to the metal support rod 30. The binder may be of the same type as that used for adhering the zirconium oxide layer 6 to the discharge vessel 5. After the organic binder has dried it is heated to drive off any excess organic material and left behind is the layer of zirconium oxide 40 adherent to the metal support rod 30.

To further reduce photoelectron production the metal support rod 30 is nonlinear and bowed or curved to generally follow the contour of the outer envelope 22. This is effective to maximize the distance between the discharge device 21 and the metal support rod 30 and thereby minimize the production of photoelectrons. It also imparts mechanical rigidity to the support rod 30 to allow it to support the discharge device 21 without being anchored at its end opposite the lamp stem press.

Although FIG. 2 shows the metal support rod 30 to be bent as a series of straight segments it could have been made with a smoother bend if desired. It would be impossible to cover the curved metal support rod 30 with a quartz sleeve or an alumina sleeve because of the rigidity and brittleness of the quartz or alumina. Quartz or alumina sleeves can only be used to cover straight segments of rod. Consequently, the use of quartz or alumina sleeves places a constraint on the support structure design in that the support structure cannot be made curved or bowed and at the same time be covered by a rigid and brittle sleeve.

It is desirable to keep the support rod 30 as far away as possible from the discharge device 21 to reduce the intensity of ultraviolet radiation incident on the support rod 30. The intensity of the ultraviolet radiation decreases inversely with the square of the distance from the discharge device 21 so that doubling the distance of the support rod from the discharge device will reduce the intensity of the incident ultraviolet radiation to one quarter of the value. The zirconium oxide coating, which can be applied to cover a curved support rod, thus allows the support rod to be shaped and positioned to maximize its distance from the discharge device without having to give up the use of a covering material on the support rod.

Another advantage of granular zirconium oxide is its relative low cost. Zirconium oxide in granular form is the least expensive cover for the support rod, with tubular quartz being more expensive and tubular alumina being the most expensive.

The adherence of the zirconium oxide layer 40 to the support rod 30 is affected by preparing the rod before coating by sandblasting, by the temperature at which the zirconium oxide is baked, and by the use of multiple coatings. To determine how to obtain the best adherence of the coating, metallic support rods made of nickel plated iron were coated with, and in one case without, the support rods first being sandblasted, with the coatings baked at different temperatures, and with one or two coatings. The data is summarized in the Table I, below.

TABLE I

| Samples | Sandblast | First Coating Temp. (°C.-1 hr.) | Second Coating Temp. (°C.-1 hr.) |
|---|---|---|---|
| A | No | 400 | — |
| B | Yes | 400 | — |
| C | Yes | 400 | 400 |
| D | Yes | 500 | 500 |
| E | Yes | 600 | 600 |
| F | Yes | 625 | — |

It was found that the zirconium oxide coatings of samples B had the best adherence, with samples C also having very good adherence. The zirconium oxide coatings of samples A, which were not sandblasted, did not adhere as well as those of samples B or C. Samples D, E, and F had zirconium coatings that did not adhere as well as those of samples B or C and which exhibited a tendency to flake more the higher the temperature at which the coating was baked.

In order to evaluate the effectiveness of the invention lamps were made having the structures shown in FIGS. 1 and 2 of the application. The lamp according to the invention had a zirconium oxide layer on the nickel plated iron support rod coated as in sample B of Table I, above. One type of prior art lamp had a quartz sleeve ($SiO_2$) over the support rod and another prior art lamp had an alumina sleeve ($Al_2O_3$) sleeve over the support rod.

The lamps were otherwise identical 100 watt metal halide high intensity discharge lamps. The discharge vessel fill was 10 milligrams of mercury, 10.5 milligrams of sodium iodide (NaI), 2.0 milligrams of mercury iodide ($HgI_2$) and 0.5 milligrams of scandium (Sc). The discharge vessel also contained argon at 100 Torr, and the lamp outer envelope contained nitrogen at 200 Torr.

The lamps were operated for 3000 hours and the lamp voltage, change in lamp voltage, efficacy and maintenance were determined. This data is shown in Table II for comparison.

TABLE II

| Lamp Parameter | Layer Composition | Lamp Operating Time (hr) 100 | 1000 | 2000 | 3000 |
|---|---|---|---|---|---|
| Voltage (V) | $ZrO_2$ | 91.2 | 93.2 | 91.9 | 87.9 |
| | $SiO_2$ | 95.7 | 99.2 | 99.8 | 102.0 |
| | $Al_2O_3$ | 95.9 | 96.8 | 101.2 | 101.9 |
| Change in Voltage (V) | $ZrO_2$ | — | 2.0 | 0.7 | −3.3 |
| | $SiO_2$ | — | 3.5 | 4.1 | 6.3 |
| | $Al_2O_3$ | — | 0.9 | 5.3 | 6.0 |
| Efficacy (Lu/W) | $ZrO_2$ | 82.5 | 79.5 | 71.2 | 65.3 |
| | $SiO_2$ | 91.6 | 82.6 | 72.3 | 60.0 |
| | $Al_2O_3$ | 88.9 | 85.2 | 76.7 | 73.0 |
| Maintenance (%) | $ZrO_2$ | — | 96.4 | 86.3 | 79.2 |
| | $SiO_2$ | — | 90.2 | 78.9 | 65.5 |
| | $Al_2O_3$ | — | 96.2 | 86.6 | 82.1 |

As was expected, in both the lamp having a quartz sleeve and the lamp having an alumina sleeve, the lamp voltage increased during the first 3000 hours of operation. On the other hand, in the lamp according to the invention, after an initial voltage rise at 1000 hours, the lamp voltage progressively decreased. This is an unexpected result and is markedly different behavior compared to the prior art lamps. The decrease in lamp voltage with time in the present invention is inconsistent with substantial sodium clean-up occurring due to photoelectron production. Accordingly, there is a strong basis for inferring a substantial diminution in photoelectron production.

The change in lamp efficacy, or maintenance, for the different lamps is also shown in Table II. The lamp according to the invention having the zirconium oxide coating demonstrated substantially improved maintenance throughout the test period, as compared to the lamp having a quartz sleeve. Surprisingly, the maintenance of the lamp having an alumina sleeve was slightly better than even the present invention. The lamp having a quartz sleeve exhibited the drop in efficacy that is characteristic of metal halide lamps.

The improved performance of the present invention, relative to lamps having quartz or alumina sleeves can be explained by the different work function values of the various materials. These are shown in the following Table III.

TABLE III

| Material | Work Function (eV) |
|---|---|
| metal | 4.0 |
| $Al_2O_3$ | 4.7 |
| 254 nm UV photon 4.9 eV | |
| $SiO_2$ | 5.0 |
| $ZrO_2$ | 5.8 |

The 254 nm UV photons emitted from the mercury vapor discharge have an energy of about 4.9 eV. Alumina has a slightly lower work function of about 4.7 eV while quartz has a slightly greater work function of 5.0 eV. On the other hand zirconium oxide has a work function of 5.8 eV. Consequently, there is a substantially lower probability that a UV photon will cause the ejection of a photoelectron when it interacts with the zirconium oxide layer. Therefore fewer photoelectrons are produced and fewer photoelectrons contribute to sodium clean-up.

Although the invention has been described in connection with a metal halide discharge lamp it is applicable to any type of lamp, such as mercury vapor lamps, which generate a UV flux during operation.

What is claimed is:

1. In an electric lamp having an outer envelope and a light source that emits ultraviolet radiation, the improvement comprising: a metallic frame for mounting said light source within said outer envelope; and a layer of $ZrO_2$ covering a substantial portion of said frame and being effective to shield said substantial portion of said frame from ultraviolet radiation emitted by said light source to reduce photoelectron emission from said frame.

2. In an electric lamp according to claim 1, wherein said layer of $ZrO_2$ is comprised of granular $ZrO_2$.

3. In an electric lamp having an outer envelope and a light source that emits ultraviolet radiation, the improvement comprising: said outer envelope having an outwardly bulged bulbous shape; a metallic frame for mounting said light source within said outer envelope, said metallic mounting frame comprising a bent rod extending along the length of said length envelope, away form said light source and adjacent said outer envelope to maximize the distance between said metallic frame and said light source; and a layer of material disposed on and covering a substantial portion of said bent rod and being effective to shield said substantial portion of said bent rod from ultraviolet radiation.

4. In an electric lamp according to claim 3, wherein said layer is comprised of $ZrO_2$.

5. In an electric lamp according to claim 4, wherein said layer of $ZrO_2$ is comprised of granular $ZrO_2$.

6. In an electric lamp according to claim 3, said layer of material having a photoelectric work function greater than about 5.0 electron volts.

7. In an electric lamp according to claim 6, wherein said layer is comprised of $ZrO_2$ and has a photoelectric work function of about 5.8 electron volts.

8. In an electric discharge lamp: a discharge light source that emits ultraviolet radiation; mounting means comprising a nonlinear metallic support rod for mounting said discharge light source within the lamp; and a layer of material having a photoelectric work function greater than 5.0 electron volts disposed on and covering a substantial portion of said nonlinear metallic support rod for shielding said covered substantial portion from the ultraviolet radiation.

9. In an electric discharge lamp according to claim 8; said layer of material having a photoelectric work function greater than 5.0 electron volts comprising $ZrO_2$.

* * * * *